United States Patent [19]

Theurer

[11] Patent Number: 4,770,104

[45] Date of Patent: Sep. 13, 1988

[54] MOBILE INSTALLATION FOR CLEANING BALLAST AND SUBSEQUENTLY TAMPING A CORRECTED TRACK

[75] Inventor: Josef Theurer, Vienna, Austria

[73] Assignee: Franz Plasser Bahnbaumaschinen Industriegesellschaft, Vienna, Austria

[21] Appl. No.: 944,367

[22] Filed: Dec. 22, 1986

[30] Foreign Application Priority Data

Feb. 12, 1986 [AT] Austria ..... 360/86

[51] Int. Cl.[4] ..... E01B 27/10; E01B 27/17

[52] U.S. Cl. ..... 104/7.2; 37/104; 104/7.3

[58] Field of Search ..... 104/2, 7.2, 7.3, 12; 171/16; 37/104–107

[56] References Cited

U.S. PATENT DOCUMENTS

| | | | |
|---|---|---|---|
| 3,426,329 | 2/1969 | Holley et al. | 171/16 |
| 3,687,081 | 8/1972 | Plasser et al. | 104/12 |
| 4,257,331 | 3/1981 | Theurer et al. | 104/2 |
| 4,370,819 | 2/1983 | Ingram | 32/104 |
| 4,430,944 | 2/1984 | Theurer | 104/7 R |
| 4,538,687 | 9/1985 | Theurer et al. | 171/16 |

FOREIGN PATENT DOCUMENTS

| | | |
|---|---|---|
| 1191739 | 8/1985 | Canada . |
| 2135369 | 2/1986 | United Kingdom . |

*Primary Examiner*—Sherman D. Basinger

*Assistant Examiner*—Edwin L. Swinehart

*Attorney, Agent, or Firm*—Collard, Roe & Galgano

[57] ABSTRACT

A mobile installation for cleaning the ballast supporting a track and subsequently leveling the track and tamping ballast under the ties of the leveled track comprises a ballast cleaning machine movable in an operating direction along the track and a track leveling, lining and tamping machine following the ballast cleaning machine in the operating direction, the track leveling, lining and tamping machine. The latter machine comprises a self-propelled machine frame, two undercarriages supporting the frame for movement in the operating direction along the track, the undercarriages being sufficiently spaced apart in this direction to permit lifting and lateral movement of the track therebetween, a ballast tamping unit mounted on the frame between the undercarriages and comprising pairs of vibratory and reciprocatory tamping tools for tamping ballast under respective ones of the ties, a track lifting and lining unit mounted on the machine frame between the undercarriages and ahead of the ballast tamping unit in the operating direction, and a ballast receiving and storage container mounted on the machine frame ahead of the track lifting and lining unit, the container having adjustable outlet ports for distributing ballast in the cribs. A conveyor arrangement is mounted on the machine frame for receiving cleaned ballast from the ballast cleaning machine and for conveying the received cleaned ballast to the ballast receiving and storage container.

15 Claims, 1 Drawing Sheet

Figures 1, 2, 3, 4:
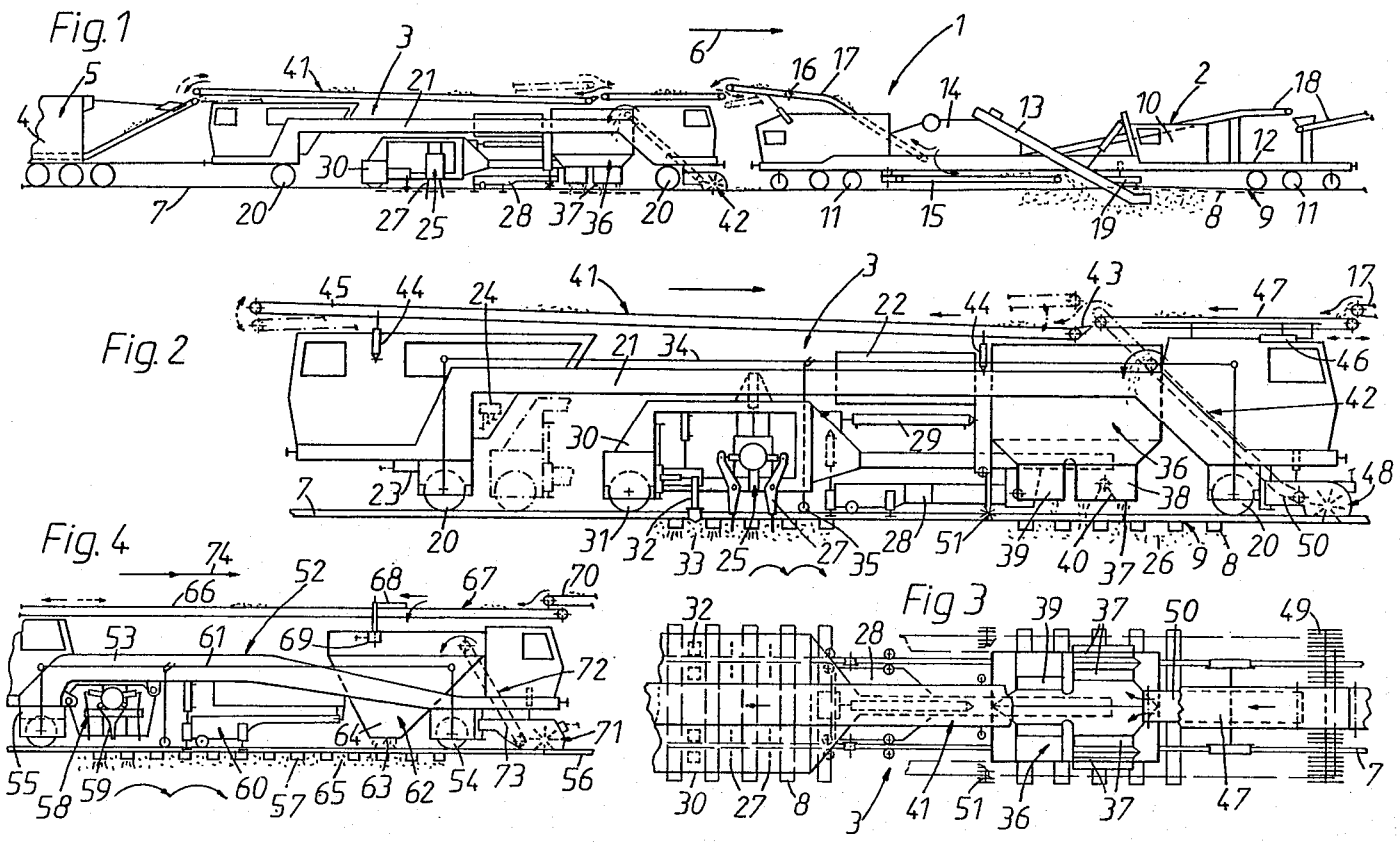

MOBILE INSTALLATION FOR CLEANING BALLAST AND SUBSEQUENTLY TAMPING A CORRECTED TRACK

The present invention relates to a mobile installation for cleaning the ballast supporting a track comprised of rails fastened to successive ties defining cribs therebetween and subsequently leveling the track and tamping ballast under the ties of the leveled track.

Canadian Pat. No. 1,191,739, issued Aug. 13, 1985, discloses a track leveling, lining and tamping machine which intermittently advances from tamping stage to tamping stage. Such a machine may be used in conjunction with other track working machines, such as a ballast cleaning machine operating ahead of the track leveling, lining and tamping machine, in the operating direction, and a track bed stabilizing machine following the track leveling, lining and tamping machine to form a mechanical track rehabilitation train. The track working machines of this train are independently driven. The encrusted ballast removed from the track bed by the excavating chain of the ballast cleaning machine is cleaned thereon and the cleaned ballast is redistributed to enable the succeeding track leveling, lining and tamping machine to tamp the cleaned ballast under the leveled and lined track at the intersections of the ties and track rails. After stabilization, the lined track is firmly positioned at a correct level. However, the tamped ballast supports for the track at the intersections of the ties and rails are not always uniform because the cleaned ballast is not quite uniformly distributed by the ballast cleaning machine preceding the track tamper.

U.S. Pat. No. 4,430,044, dated Feb. 14, 1984, discloses a mobile apparatus and method for cleaning ballast supporting a track. This apparatus is comprised of a ballast cleaning machine with a track lifting mechanism capable of raising the track a considerable amount and a track tamping machine coupled to the front end of the ballast cleaning machine, in the operating direction. The waste component is transported away from the ballast cleaning machine over the track tamping machine by an endless conveyor band arranged above the frame of the track tamping machine and an additional, shorter endless conveyor band transporting the waste component to a car of a freight train preceding the track tamping machine. A ballast tamping unit and a track lifting unit associated therewith and preceding it in the operating direction is longitudinally displaceably mounted on the track tamping machine frame to enable the successive ties to be tamped while the machine advances continuously. The track tamping machine carries a further track lifting mechanism to lift the track sufficiently for providing space for the ballast excavating chain on the ballast cleaning machine to be placed under the track for removing a desired amount of ballast for cleaning. A similar apparatus is known from U.S. Pat. No. 4,538,687, dated Sept. 3, 1985, which discloses a non-stop operating ballast cleaning machine preceded, in the operating direction, by a track lifting and ballast tamping unit. This unit is longitudinally displaceable for intermittent advancement thereof and is pivotally coupled to the frame of the ballast cleaning machine. The track lifting and tamping unit enables the track to be lifted by tamping ballast under the ties so that the excavating chain of the succeeding ballast cleaning machine, which extends transversely in the ballast bed underneath the track, does not unduly bend the track rails.

British Pat. No. 2,135,369, published Feb. 12, 1986, discloses a continuously moving track leveling, lining and tamping machine which has a main frame advancing continuously along the track while a tool carrier between the undercarriages has one end pivotally connected to the main frame and an opposite end supported by a guide carriage for intermittently advancing the carrier from tamping stage to tamping stage. A tamping tool unit is mounted on the tool carrier immediately preceding the guide carriage, in the operating direction, and a track lifting and lining unit is arranged on the tool carrier preceding the tamping tool unit. An hydraulically operated cylinder-piston drive adjusts the position of the tool carrier relative to the main frame at the point where the one tool carrier end is pivotally supported on the main frame. Such a non-stop operable track tamper has not only proven to be very productive in track rehabilitation work but provides a much more comfortable working environment for the machine operators than conventional tampers, is highly energy-effective and greatly saves wear on the machine drive and brakes because the operators sitting on the heavy main frame are not subjected to intermittent acceleration and deceleration impacts.

U.S. Pat. No. 4,257,331, dated Mar. 24, 1981, discloses a mobile track surfacing machine comprising a ballast cleaning machine and a trailing track compacting machine coupled thereto. A thrust ballast tamping unit is longitudinally displaceably mounted on the frame of the trailing machine between the undercarriages thereof and a track lifting and lining unit precedes the thrust ballast tamping unit and is fixedly mounted on the frame. The tamping unit has thrust tamping tools immersible in the cribs for compacting the ballast therein, and this requires a relatively large amount of ballast, which is made available by extending a ballast conveyor beyond the rear end of the preceding ballast cleaning machine over a ballast storage bin at the front end of the trailing machine frame. The bin has a ballast output chute with a shutter controllable by a drive whereby clean ballast may be delivered in metered amounts into the cribs so that a sufficient amount of ballast is available for effective tamping by the thrust tamping tools, the major amount of the cleaned ballast being redistributed through the chute on the ballast cleaning machine. The ballast compaction provided by the thrust tamping tools in the cribs is useful only to provide sufficient track stability immediately after the ballast cleaning operation to permit high-speed train traffic to pass but this machine cannot be used for permanent and accurate track correction and tamping obtained with pairs of vibratory and reciprocatory tools tamping the ballast under the ties after the track has been properly positioned by a track lifting and lining unit keeping a constant distance from the tamping unit, the track lifting unit of the trailing auxiliary machine being fixed on the machine frame too close to the front axle to permit substantial track lifting while the crib ballast compacting unit moves back and forth.

It is the primary object of this invention to improve the last-described installation in such a manner as to assure an accurate positioning of the track and an effective and lasting fixing of the repositioned track immediately after the ballast has been cleaned, and without requiring the use of a subsequently following track leveling, lining and tamping machine.

The invention accomplishes this and other objects with a mobile installation of the first-indicated type, which comprises a ballast cleaning machine movable in an operating direction along the track and a track leveling, lining and tamping machine following the ballast cleaning machine in the operating direction. The track leveling, lining and tamping machine comprises a machine frame, two undercarriages supporting the frame for movement in the operating direction along the track, the undercarriages being sufficiently spaced apart in said direction to permit lifting and lateral movement of the track therebetween, a drive for moving the machine frame along the track, a ballast tamping unit mounted on the frame between the undercarriages and comprising pairs of vibratory and reciprocatory tamping tools for tamping ballast under respective ones of the ties, a track lifting and lining unit mounted on the machine frame between the undercarriages and ahead of the ballast tamping unit in the operating direction, and a ballast receiving and storage container mounted on the machine frame ahead of the track lifting and lining unit, the container having adjustable outlet port means for distributing ballast in respective ones of the cribs. A conveyor means is arranged on the machine frame for receiving cleaned ballast from the ballast cleaning machine and for conveying the received cleaned ballast to the ballast receiving and storage container.

This mobile installation for the first time enables effective ballast supports for the track to be produced under the ties without requiring a ballast planing or redistributing machine to be used between the ballast cleaning machine and a succeeding ballast tamper, the vibratory and reciprocatory tamping tools effectively tamping the redistributed ballast under the ties after the track has been accurately leveled and/or lined. Thus, immediately after the installation has completed its work, the track is in condition for high-speed train traffic on a permanent basis. The arrangement of the conveyor means on the frame of the track leveling, lining and tamping machine makes the operation of this machine independent of that of the continuously advancing ballast cleaning machine so that it is possible to use an intermittently advancing track leveling, lining and tamping machine in the installation of the present invention. This independent operation makes it possible to use the installation along a track section whose level error is considerable and which, therefore, requires substantial raising of the track and repeated tie tamping by immersing the tamping tools several times in the ballast to obtain sufficient tamping of the substantial amount of ballast under the raised ties. In this manner and independently of the forward speed of the ballast cleaning machine and the different track levels encountered along the track after the complete renewal of the ballast bed, it is possible to obtain uniformly tamped ties along the entire newly surfaced track. The conveyance of cleaned ballast to the ballast receiving and storage container may be effected advantageously when the distance between the ballast cleaning machine and the following track leveling, lining and tamping machine is at a minimum.

The above and other objects, advantages and features of this invention will become more apparent from the following detailed description of certain now preferred embodiments thereof, taken in conjunction with the accompanying, somewhat schematic drawing wherein FIG. 1 is a side elevational view of a mobile installation for cleaning the ballast supporting a track and subsequently leveling and/or lining the track and tamping ballast under the ties of the leveled and/or lined track, followed by a ballast transport freight train, FIG. 2 is an enlarged side elevation of the track leveling, lining and tamping machine of the installation of FIG. 1, FIG. 3 is a fragmentary top view of the machine shown in FIG. 2, and FIG. 4 is a side elevation of an intermittently advancing track leveling, lining and tamping machine with a twin tamping unit for simultaneously tamping two successive ties, for an alternate use in the mobile installation of FIG. 1.

Referring to the drawing and first to FIGS. 1 to 3, there is shown mobile installation 1 for cleaning the ballast supporting track 9 comprised of rails 7 fastened to successive ties 8 defining cribs 33 therebetween and subsequently leveling track 9 and tamping ballast 26 under ties 8 of the leveled track. This installation comprises ballast cleaning machine 2 movable along the track inan operating direction indicated by arrow 6, track leveling, lining and tamping machine 3 following ballast cleaning machine 2 in the operating direction and freight train 5 following the track leveling, lining and tamping machine in the operating direction and comprised of a succession of freight cars 4 for transporting ballast.

Generally conventional ballast cleaning machine 2 is independently movable by its own drive 10 and its frame 12 runs on undercarriages 11, 11 on track 9. Machine frame 12 carries vertically adjustable endless ballast excavating and conveying chain 13 which excavates the ballast under the track and conveys the excavated ballast to vibratory screening arrangement 14 which cleans the excavated ballast and drops the cleaned ballast on ballast redistributing conveyors 15 mounted on machine frame 12 and pivotal in a horizontal plane to throw the cleaned ballast back on the excavated track section. Ballast cleaning machine frame 12 further carries conveyor band 17 having an input end for receiving available excess cleaned ballast from screening arrangement 14 and a discharge end projecting from a rear end of ballast cleaning machine 1. This conveyor band is pivotal about pivot axle 16 extending transversely to the operating direction to enable the conveyor band ends to be raised or lowered, as desired. Track lifting and shifting unit 19 is vertically adjustably mounted on ballast cleaning machine frame 12 in the range of ballast excavating and conveying chain 13 to enable the track to be lifted and shifted to accommodate chain 13 thereunder.

Track leveling, lining and tamping machine 3 follows ballast cleaning machine 1 at a short distance therebehind at the same forward speed. This machine comprises elongated machine frame 21 and two undercarriages 20, 20 supporting machine frame 21 for movement in the operating direction along the track, the undercarriages being sufficiently spaced apart in this direction to permit lifting and lateral movement of the track therebetween. As is conventional, operator's cabs are mounted on each end of machine frame 21 and the machine is self-propelled, for which purpose it has power supply 22 and drive 23 for moving the machine frame along the track. The machine frame also carries central control 24. Vertically adjustable ballast tamping unit 25 is mounted on machine frame 21 between undercarriages 20, 20 and comprises pairs of vibratory and reciprocatory tamping tools 27 for immersion in ballast 26 for tamping ballast under respective ties 8. Track lifting and lining unit 28 is mounted on machine frame 21 between undercarriages 20, 20 and ahead of ballast tamping unit 25 in the operating direction. In the illustrated embodiment, tool carrier frame 30 supports ballast tamping unit 25 and track lifting and lining unit 28, undercarriage 31 supports one end of tool carrier frame 30 on track 9 and guide roller means connects an opposite pole-shaped end of the tool carrier frame to machine frame 21 for longitudinal movement with respect thereto. Drive 29 is linked between tool carrier frame 30 and machine frame 21 for effectuating the longitudinal movement whereby track leveling, lining and tamping machine 3 may move continuously with ballast cleaning machine 1 along the track in the operating direction while tool carrier frame 30 is driven intermittently, as schematically indicated by the small arcuate arrows shown in FIG. 2 under unit 25. This arrangement relieves machine frame 21 of the heavy weight of the ballast tamping unit and enhances the tamping efficiency while enabling the track leveling, lining and tamping machine to receive a continuous supply of cleaned ballast from the ballast cleaning machine. The efficiency of the entire installation is increased by the continuous and synchronizable advance of the two machines along the track to be surfaced.

Conventional track lifting and lining unit 28 comprises pairs of pivotal lifting rollers for gripping track 9 and a pair of flanged lining rollers supporting unit 28 on track rails 7, lifting and lining drives linking unit 28 to a forward end of tool carrier frame 30. As is also conventional, leveling and lining reference system 34 is mounted on machine 3 and comprises a tensioned reference wire received in a fork-shaped potentiometer carried by sensing roller 35 vertically adjustably mounted on tool carrier frame 30.

In the illustrated embodiment, ballast compacting device 32 is also vertically adjustably mounted on tool carrier frame 30 behind ballast tamping unit 25 in the operating direction for compacting ballast in a respective crib 33. As shown in FIG. 2, ballast compacting device 32 is longitudinally displaceably mounted on tool carrier frame 30 for selective spacing from ballast tamping unit 25. This combination of a tie tamping unit with a succeeding crib compacting device has the advantage that the tamped tie support is reinforced by the compaction of the ballast in the cribs. This prevents any tamped ballast from escaping sideways from under the ties and thus increases the permanency of the tamping.

According to this invention, track leveling, lining and tamping machine 3 further comprises ballast receiving and storage container 36 mounted on machine frame 21 ahead of track lifting and lining unit 28, i.e. between this unit and front undercarriage 20. The container has adjustable outlet port means 37, 38 for distributing ballast in respective cribs 33. As shown in FIG. 3, the illustrated outlet port means comprises for adjustable outlet openings 37 in the container bottom and leading therefrom four outlet chutes 38 aligned transversely to the operating direction along ties 8, respective pairs of outlet chutes 38 being arranged above a respective intersection of rails 7 and a respective tie 8 at each side of the rails. Two additional outlet chutes 39 are arranged behind the four outlet chutes in the operating direction and also lead from adjustable outlet openings in the bottom of container 36, outlet chutes 39 being arranged between the track rails. The container outlet openings are adjusted by hydraulically operable gates 40 which are pivotal about axes extending transversely to the operating direction. For a clearer view, these pivotal gates have not been shown in FIG. 3. This array of the four outlet chutes enables ballast to be distributed at the points of tamping, the adjustment of the ballast flow through these outlet chutes making it possible, for example, to supply more or less ballast at one or the other rail, depending on whether the ballast redistributing conveyors 15 on the ballast cleaning machine have deposited less or more ballast at the respective rails. Outlet chutes 39 will aid in filling up the center of the ballast bed.

In further accordance with this invention, conveyor means 41, 42 is arranged on machine frame 21 for receiving cleaned ballast from the ballast cleaning machine and for conveying the received cleaned ballast to ballast receiving and storage container 36. Conveyor means 41 is arranged for the selective conveyance of the received cleaned ballast to container 36 or of any excess of the received cleaned ballast away from the container to ballast transport freight train 5. This conveyor means comprises forward conveyor band 47 having an input end arranged to receive the cleaned ballast from the discharge end of conveyor band 17 of ballast cleaning machine 1 and a discharge end arranged to discharge the cleaned ballast into container 36, and rear conveyor band 45 having a first end adjacent the forward conveyor band discharge end and a second end projecting from a rear end of machine frame 21, in the operating direction. Deflecting device 43 selectively deflects ballast either from the forward conveyor band discharge end to the first rear conveyor band end or from the forward conveyor band discharge end to container 36. Drive means 44 links the first rear conveyor band end to machine frame 21 for lifting and lowering this end, and additional like drive means 44 enables the second rear conveyor band end to be lowered and lifted, preferably during the operation of the installation.

With such a conveyor means bridging over the machine frame of the track leveling, lining and tamping machine, it is possible to regulate the ballast flow very advantageously for supplying a uniform amount of cleaned ballast to the tamping sites, regardless of the quantity of cleaned ballast coming from the ballast cleaning machine. This uniform ballast supply, combined with the simultaneous tamping of the supplied ballast under the successive ties, results in a very uniform ballast support for the leveled and/or lined track and a correspondingly stable track positioning. Any excess ballast can be moved away in a very simple manner by conveying it over the machine frame to cars of a succeeding ballast transport train. This is of particular advantages in railroad yards where there is no room at the track shoulders for depositing ballast.

With the arrangement of forward conveyor band 47, rear conveyor band 45, pivotally arranged conveyor 17 conveying cleaned ballast from a rear end of ballast cleaning machine 2 to the input end of forward conveyor band 47, and means 43 in the range of ballast receiving and storage container 36 for selectively delivering the cleaned ballast either from the forward conveyor band discharge end to the first end of rear conveyor band 45 or from the discharge end of forward conveyor band 47 to container 36, a simple conveyor means is provided for selecting the ballast flow according to requirements. Thus excessive cleaned ballast may be conveyed directly to the ballast transport train following mobile installation 1 or, if there is not enough cleaned ballast, to convey some ballast from the transport train to the ballast receiving and storage container. All or some of the conveyed ballast may be delivered to container 36.

In the illustrated embodiment, endless forward conveyor band 47 projects from a front end of machine frame 21 towards ballast cleaning machine 2 and is displaceable by drive means 46 in the operating direction towards the ballast cleaning machine and retractible therefrom. This enables the projection of the forward conveyor band from the front machine frame end to be varied and thus to assure a trouble-free transfer of the cleaned ballast from the ballast cleaning machine to the track leveling, lining and tamping machine when the spacing between the two independently advancing machines varies.

Conveyor means 42 shown comprises vertically adjustable broom arrangement 48 mounted on a front end of machine frame 21, in the operating direction. The broom arrangement comprises rotary broom 49 for sweeping ballast off the track and endless ballast elevating conveyor band 50 having an input end adjacent the broom for receiving swept ballast therefrom and a discharge end adjacent ballast receiving and storage container 36 for delivering the swept ballast thereto. As shown in chain-dotted lines in FIG. 2, elevating conveyor band 50 is extensible so that it may discharge the swept ballast into container 36 or to succeeding rear conveyor band 45 extending from the container towards a rear end of machine frame 21. This arrangement makes the operation of the track leveling, lining and tamping machine even more independent from the operation of the ballast cleaning machine since the cleaned ballast is deposited directly on the track and any excess, swept-up ballast is elevated from the track to be conveyed selectively to the ballast receiving and storage container or rearwards to the ballast transport train.

Endless conveyor bands 45, 45 of conveyor means 41 may be arranged for reversible conveyance of ballast to the ballast cleaning machine in the operating direction and of the received cleaned ballast away from ballast cleaning machine 2 in a direction opposite to the operating direction. This enables the installation to be readily adapted to the prevailing ballast conditions since the same conveyor means may be used to remove excess cleaned ballast or to supply additional need ballast, assuring that the required amount of ballast will at all times be available at the tamping sites.

In the embodiment of FIG. 4, conveyor means 67 is comprised of a single, reversibly drivable endless conveyor band 66 extending substantially over the length of machine frame 53 of track leveling, lining and tamping machine 52. Two undercarriages 54 support frame 53 for movement along the track comprised of rails 56 fastened to successive ties 57 in the operating direction indicated by arrow 74. Drive 55 moves the machine frame intermittently along the track from tamping stage to tamping stage. Twin ballast tamping unit 58 is vertically adjustably mounted on machine frame 53 between the undercarriages and close to the rear undercarriage. The ballast tamping unit comprises successive pairs of vibratory and reciprocatory tamping tools for simultaneously tamping ballast under two successive ties. Track lifting and lining unit 60 is mounted on machine frame 53 between the undercarriages ahead of ballast tamping unit 58 in the operating direction. The track lifting and lining unit has a pair of lining rollers supporting the unit on track rails 56 and pairs of pivotal flanged lifting rollers for gripping the track rails, lifting and lining drives connecting a rear end of the unit to machine frame 53 while its front end is linked to the frame. Leveling and lining reference system 61 controls the operation of the lifting and lining drives. Ballast receiving and storage container 62 is mounted on machine frame 53 ahead of track lifting and lining unit 60. Adjustable outlet ports 63 are defined in the bottom of container 62 and lead to four outlet chutes 64 adjacent to each other in the longitudinal direction of ties 57 for supplying ballast to cribs 65.

Reversibly drivable endless conveyor band 66 is mounted above machine frame 53 and controllably deflecting baffle means 68 comprised of a metal guide sheet is mounted above ballast receiving and storage container 62 for selectively deflecting the conveyed ballast into container 62 or for retaining the conveyed ballast on the endless conveyor band. For this purpose, drive 69 is affixed to the ballast receiving and storage container and the drive is connected to sheet metal guide 68 which is pivotal about a vertical axis. The drive is remote-controlled for pivoting the sheet metal guide in selected positions extending above the endless conveyor band or laterally parallel thereto. The arrangement of a single conveyor band assures a particularly simple and trouble-free conveyor means operation for the cleaned and any excess ballast being moved selectively to the ballast receiving and storage container or to a succeeding ballast transport train. The controlled pivoting of sheet metal guide 68 enables any desired portion of the conveyed ballast to be directed into container 62 for filling it without interrupting the ballast flow along the conveyor means.

In the embodiment of FIG. 4, a discharge end of cleaned ballast conveyor 70 projects from the rear end of a preceding ballast cleaning machine over a forward input end of endless ballast conveyor band 66 to deliver cleaned ballast thereto. Furthermore, conveyor means 71 for excess ballast is shown to comprise vertically adjustable broom arrangement 72 mounted on a front end of machine frame 53, in the operating direction. The broom arrangement comprises a rotary broom for sweeping ballast off the track and endless ballast elevating conveyor band 73 having an input end adjacent the broom for receiving swept ballast therefrom and a discharge end adjacent ballast receiving and storage container 62 for delivering the swept ballast thereto.

The operation of mobile installation 1 will be partly obvious from the above-described structure thereof and will be explained in detail hereinafter.

Referring first to the embodiment of FIGS. 1 to 3, ballast cleaning machine 2 and track leveling, lining and tamping machine 3 are operated in tandem while being continuously advanced in the operating direction along track 9. The forward speeds of the machines are so synchronized that the distance between the two advancing machines remains more or less constant. The ballast excavated by endless excavating and conveying chain 13 and elevated thereby to screening arrangement 14 is cleaned thereon and a selected portion of the cleaned ballast is directed from the screening arrangement onto ballast redistributing conveyor bands 15, which throw the cleaned ballast back under the track, while another selected portion, as shown by the small arrows in FIG. 1, is directed onto conveyor 17 whose discharge end projects rearwardly from the ballast cleaning machine. The latter portion is any excess no longer needed for the new ballast bed since there usually is too much ballast available after cleaning when the excavated ballast contained relatively little dirt and since the loose, redistributed cleaned ballast produces a larger ballast volume than the compacted ballast did before cleaning. As shown by the small arrows, this excess cleaned ballast is conveyed from the discharge end of conveyor 17 to the input end of forward endless conveyor band 47 of conveyor means 41 mounted on track leveling, lining and tamping machine 3. During this operation, conveyor band 47 is longitudinally displaced by drive 46 so that its rear discharge end extends just above deflecting device 43. In the illustrated position of the deflecting device, the conveyed cleaned ballast is not thrown into ballast receiving and storage container 36 therebelow but is deflected onto rear endless conveyor band 45 of conveyor means 41 whose forward end has been pivoted by drive 44 so that it is lowered below the discharge end of forward conveyor band 47. Conveyor band 45 conveys this excess cleaned ballast to ballast transport train 5 in whose cars it is stored. At the same time, rotary broom 49 of broom arrangement 48 will sweep up excess ballast and retracted elevating conveyor 50 conveys the swept-up ballast into container 36. Any additional ballast required for proper tamping of the ties is then discharged from the ballast receiving and storage container through controllable outlet port means 37 into cribs 33.

If there is not enough ballast in container 36 to meet the requirements for uniform tie tamping, deflecting device 43 may be pivoted rearwardly so that a portion of the ballast conveyed by conveyor band 47 is dropped into container 36 while another portion is thrown onto conveyor band 45. In other words, a part of the excess cleaned ballast is used for filling cribs 33 while the remaining part thereof is conveyed to train 5. If the ballast receiving and storage container is almost empty, deflecting device 43 may be pivoted entirely towards the rear so that the entire cleaned ballast is thrown from the discharge end of conveyor band 47 into container 36. All of these adjustments may be effected during the operation of mobile installation 1 while machines 2 and 3 continuously advance along the track.

Another possibility for conveying the cleaned ballast is provided by conveyor means 42. In this case, forward conveyor band 47 is retracted, i.e. it is displaced in the operating direction, and elevating conveyor band 50 is extended to assume the position shown in chain-dotted lines in FIG. 2. This enables excess cleaned ballast redistributed by conveyor bands 15 to be swept off track 9 and to be moved by broom arrangement 48 directly to rear conveyor band 45 which conveys this excess ballast to train 5.

On the other hand, conveyor bands 45 and 47 may be reversed to enable stored ballast to be moved from ballast transport train 5 to ballast receiving and storage container 36 or directly to conveyor 17 and ballast redistributing conveyors 15 of ballast cleaning machine 2. This return of the ballast in the operating direction becomes necessary if too little cleaned ballast is produced on screening arrangement 14 for filling the excavated space under track 9 because the excavated ballast contained too much dirt that had to be separated on the screening arrangement or if the ballast was so dirty and encrusted along a section of the track that it had to be removed entirely. For this reverse operation, drives 44 are operated to pivot rear conveyor band 45 about a transverse axis to lower the rear end of the rear conveyor band and raise the front end thereof so that the rear conveyor band assumes the position shown in chain-dotted lines in FIGS. 1 and 2. In the lowered position, the rear end of rear conveyor band 45 is arranged below the discharge end of a conveyor moving ballast from car 4 of ballast transport train 5 and conveyor 17 is pivoted about transverse axis 16 so that the rearwardly projecting end of conveyor 17 is arranged below the front end of forward conveyor band 47, as shown in dash-dotted lines in FIG. 1. Upon driving the conveyor bands of conveyor means 41 on machine 3 and of the conveyor means of machine 2 in the operating direction, cleaned ballast is moved from train 5 over machine 3 to ballast redistributing conveyors 15 of machine 2. The redistributing conveyors are swung in a horizontal plane to throw the cleaned ballast on the subgrade under the track. In this operation, too, it is possible to pivot deflecting device 43 into a position permitting some or all of the conveyed ballast to be diverted into ballast receiving and storage container 36. As soon as this track section containing the heavily encrusted ballast is passed and screening arrangement 14 again produces excess cleaned ballast, the conveying direction of the conveyors is reversed to move towards train 5 opposite to the operating direction.

During the entire operation of mobile installation 1, successive ties 8 of track 9 are intermittently tamped with the vibratory and reciprocatory tamping tools of ballast tamping unit 25 which is mounted on displaceable tool carrier frame 30 while the ballast in cribs 33 is compacted by compacting device 32. At the same time, required amounts of ballast are supplied through adjustable outlet port means 37 of container 36 to make certain that the ties and cribs will be uniformly tamped. Any ballast dropped on the track through the outlet port means on ties 8 will be swept into succeeding crib 33 by broom 51 rotating about an axis extending transversely to the operating direction.

Intermittently advancing track leveling, lining and tamping machine 52 of FIG. 4, which follows a continuously advancing ballast cleaning machine and operates in tandem therewith, functions in the following manner:

As shown by double arrows 74, machine 52 moves forwardly stepwise from tamping stage to tamping stage, only rearwardly projecting ballast conveyor 70 of the continuously advancing ballast cleaning machine being shown. To compensate for the intermittently changing distance between the two machines, conveyor 70 must overlap conveyor means 67. Excess cleaned ballast is conveyed by conveyor 70 of the ballast cleaning machine to conveyor means 67 and is conveyed thereby in a direction opposite to the operating direction of the installation. If sheet metal guide 68 has been pivoted into a position laterally of conveyor band 66 and extending longitudinally parallel thereto, the entire cleaned ballast coming from the ballast cleaning machine is conveyed over ballast receiving and storage container 62 rearwardly to a ballast transport train following machine 52. However, if too little ballast is stored in container 62, drive 69 is actuated by remote control to pivot the sheet metal guide or baffle into the path of the ballast conveyed on conveyor band 66 to divert a controlled amount of the conveyed ballast into the container. At the same time and independently thereof, excess ballast is also conveyed from the track by conveyor means 71 whose elevating conveyor band 73 throws the swept-up ballast directly into container 62. Outlet port means 63 can be suitably controlled to supply ballast stored in the container for tamping the ties. In this manner, ballast tamping unit 58 will provide a uniformly tamped ballast bed.

This embodiment, too, can be operated for moving ballast from a succeeding ballast transport train to the redistributing conveyors of the preceding ballast cleaning machine in the manner described hereinabove in connection with the embodiment of FIGS. 1 to 3 by reversing the driving direction of the conveyors and moving the forward end of conveyor band 66 under the rear end of ballast cleaning machine conveyor 70.

What is claimed is:

1. A mobile installation for cleaning the ballast supporting a track comprised of rails fastened to successive ties defining cribs therebetween and subsequently leveling the track and tamping ballast under the ties of the leveled track, which comprises (a) a self-propelled ballast cleaning machine movable in an operating direction along the track, (b) an independently movable track leveling, lining and tamping machine following the ballast cleaning machine in the operating direction, the track leveling, lining and tamping machine comprising (1) a machine frame, (2) two undercarriages supporting the frame for movement in the operating direction along the track, the undercarriages being sufficiently spaced apart in said direction to permit lifting and lateral movement of the track therebetween, (3) a drive for moving the machine frame along the track, (4) a ballast tamping unit mounted on the frame between the undercarriages and comprising pairs of vibratory and reciprocatory tamping tools for tamping ballast under respective ones of the ties, (5) a track lifting and lining unit mounted on the machine frame between the undercarriages at a constant distance from the tamping unit and ahead of the ballast tamping unit in the operating direction, and (6) a ballast receiving and storage container mounted on the machine frame ahead of the track lifting and lining unit, the container having adjustable outlet port means for distributing ballast in respective ones of the cribs, and (c) a conveyor means arranged on the machine frame for receiving cleaned ballast from the ballast cleaning machine and for conveying the received cleaned ballast to the ballast receiving and storage container.

2. The mobile installation of claim 1, further comprising a tool carrier frame supporting the ballast tamping unit and the track lifting and lining unit, an undercarriage supporting one end of the tool carrier frame on the track, means connecting the tool carrier frame to the machine frame for longitudinal movement with respect thereto, and a drive for effectuating said longitudinal movement whereby the track leveling, lining and tamping machine may move continuously with the ballast cleaning machine along the track in the operating direction while the tool carrier frame is driven intermittently.

3. The mobile installation of claim 2, further comprising a ballast compacting device vertically adjustably mounted on the tool carrier frame behind the ballast tamping unit in the operating direction for compacting ballast in a respective one of the cribs.

4. The mobile installation of claim 3, wherein the ballast compacting device is longitudinally displaceably mounted on the tool carrier frame for selective spacing from the ballast tamping unit.

5. The mobile installation of claim 1, wherein the adjustable outlet port means comprises four outlet chutes aligned transversely to the operating direction, respective pairs of the outlet chutes being arranged above a respective intersection of the rails and a respective one of the ties at each side of the rails.

6. The mobile installation of claim 5, further comprising two additional outlet chutes arranged behind the four outlet chutes in the operating direction.

7. A mobile istallation for cleaning the ballast supporting a track comprised of rails fastened to successive ties defining cribs therebetween and subsequently leveling the track and tamping ballast under the ties of the leveled track, which comprises (a) a ballast cleaning machine movable in an operating direction along the track, (b) a track leveling, lining and tamping machine following the ballast cleaning machine in the operation direction, the track leveling, lining and tamping machine comprising (1) a machine frame, (2) two undercarriages supporting the frame for movement in the operating direction along the track, the undercarriages being sufficiently spaced apart in said direction to permit lifting and lateral movement of the track therebetween, (3) a drive for moving the machine frame along the track, (4) a ballast tamping unit mounted on the frame between the undercarriages and comprising pairs of vibratory and reciprocatory tamping tools for tamping ballast under respective ones of the ties, (5) a track lifting and lining unit mounted on the machine frame between the undercarriages and ahead of the ballast tamping unit in the operating direction, and (6) a ballast receiving and storage container mounted on the machine frame ahead of the track lifting and lining unit, the container having adjustable outlet port means for distributing ballast in respective ones of the cribs, and (c) a conveyor means arranged on the machine frame for receiving cleaned ballast from the ballast cleaning machine and for the selective conveyance of the received cleaned ballast to the ballast receiving and storage container, and of any excess of the received cleaned ballast away from the container.

8. The mobile installation of claim 7, wherein the conveyor means comprises a forward conveyor band having an input end arranged to receive the cleaned ballast from the ballast cleaning machine and a discharge end arranged to discharge the cleaned ballast into the container, and a rear conveyor band having a first end adjacent the forward conveyor band discharge end and a second end projecting from a rear end of the machine frame, in the operating direction, and further comprising a deflecting device for selectively deflecting ballast either from the forward conveyor band discharge end to the first rear conveyor band end or from the forward conveyor band discharge end to the container, and drive means for lifting the first rear conveyor band end.

9. The mobile installation of claim 8, further comprising additional drive means for lowering the second rear conveyor band end.

10. The mobile installation of claim 7, wherein the conveyor means comprises a forward conveyor band having an input end arranged to receive the cleaned ballast from the ballast cleaning machine and a discharge end arranged to discharge the cleaned ballast into the container, and a rear conveyor band having a first end adjacent the forward conveyor band discharge end and a second end projecting from a rear end of the machine frame, in the operating direction, and further comprising an endless conveyor band pivotally arranged on a rear end of the ballast cleaning machine for conveying the cleaned ballast to the forward conveyor band input end, and means in the range of the ballast receiving and storage container for selectively delivering the cleaned ballast either from the forward conveyor band discharge end to the first rear conveyor band end or from the forward conveyor band discharge end to the container.

11. A mobile installation for cleaning the ballast supporting a track comprised of rails fastened to successive ties defining cribs therebetween and subsequently leveling the track and tamping ballast under the ties of the leveled track, which comprises (a) a ballast cleaning machine movable in an operating direction along the track, (b) a track leveling, lining and tamping machine following the ballast cleaning machine in the operating direction, the track leveling, lining and tamping machine comprising (1) a machine frame, (2) two undercarriages supporting the frame for movement in the operating direction along the track, the undercarriages being sufficiently spaced apart in said direction to permit lifting and lateral movement of the track therebetween, (3) a drive for moving the machine frame along the track, (4) a ballast tamping unit mounted on the frame between the undercarriages and comprising pairs of vibratory and reciprocatory tamping tools for tamping ballast under respective ones of the ties, (5) a track lifting and lining unit mounted on the machine frame between the undercarriages and ahead of the ballast tamping unit in the operating direction, and (6) a ballast receiving and storage container mounted on the machine frame ahead of the track lifting and lining unit, the container having adjustable outlet port meaans for distributing ballast in respective ones of the cribs, and (c) a conveyor means arranged on the machine frame for receiving cleaned ballast from the ballast cleaning machine and for the reversible conveyance of ballast to the ballast cleaning machine in the operating direction and of the received cleaned ballast away from the ballast cleaning machine in a direction opposite to the operating direction.

12. The mobile installation of claim 11, wherein the conveyor means is comprised of a single, reversibly drivable endless conveyor band extending substantially over the length of the machine frame and mounted thereabove, and further comprising controllably deflecting baffle means mounted above the ballast receiving and storage container for selectively deflecting the conveyed ballast into the container or for retaining the conveyed ballast on the endless conveyor band.

13. A mobile installation for cleaning the ballast supporting a track comprised of rails fastened to successive ties defining cribs therebetween and subsequently leveling the track and tamping ballast under the ties of the leveled track, which comprises (a) a ballast cleaning machine movable in an operating direction along the track, (b) a track leveling, lining and tamping machine following the ballast cleaning machine in the operating direction, the track leveling, lining and tamping machine comprising (1) a machine frame, (2) two undercarriages supporting the frame for movement in the operating direction along the track, the undercarriages being sufficiently spaced apart in said direction to permit lifting and lateral movement of the track therebetween, (3) a drive for moving the machine frame along the track, (4) a ballast tamping unit mounted on the frame between the undercarriages and comprising pairs of vibratory and reciprocatory tamping tools for tamping ballast under respective ones of the ties, (5) a track lifting and lining unit mounted on the machine frame between the undercarriages and ahead of the ballast tamping unit in the operating direction, and (6) a ballast receiving and storage container mounted on the machine frame ahead of the track lifting and lining unit, the container having adjustable outlet port means for distributing ballast in respective ones of the cribs, and (c) a conveyor means arranged on the machine frame for receiving cleaned ballast from the ballast cleaning machine and for conveying the received cleaned ballast to the ballast receiving and storage container, the conveyor means comprising (1) a vertically adjustable broom arrangement mounted on a front end of the machine frame, in the operating direction, the broom arrangement comprising a rotary broom for sweeping ballast off the track and an endless ballast elevating conveyor band having an input end adjacent the broom for receiving swept ballast therefrom and a discharge end adjacent the ballast receiving and storage container for delivering the swept ballast thereto, and (2) an endless conveyor band extending from the container towards a rear end of the machine frame.

14. The mobile installation of claim 13, wherein the endless ballast elevating conveyor band is extensible.

15. A moble installation for cleaning the ballast supporting a track comprised of rails fastened to successive ties defining cribs therebetween and subsequently leveling the track and tamping ballast under the ties of the leveled track, which comprises (a) a ballast cleaning machine movable in an operating direction along the track, (b) a track leveling, lining and tamping machine following the ballast cleaning machine in the operating direction, the track leveling, lining and tamping machine comprising (1) a machine frame, (2) two undercarriages supporting the frame for movement in the operating direction along the track, the undercarriages being sufficiently spaced apart in said direction to permit lifting and lateral movement of the track therebetween, (3) a drive for moving the machine frame along the track, (4) a ballast tamping unit mounted on the frame between the undercarriages and comprising pairs of vibratory and reciprocatory tamping tools for tamping ballast under respective ones of the ties, (5) a track lifting and lining unit mounted on the machine frame between the undercarriages and ahead of the ballast tamping unit in the operating direction, and (6) a ballast receiving and storage container mounted on the machine frame ahead of the track lifting and lining unit, the container having adjustable outlet port means for distributing ballast in respective ones of the cribs, and (c) a conveyor means arranged on the machine frame for receiving cleaned ballast from the ballast cleaning machine and for conveying the received cleaned ballast to the ballast receiving and storage container, the conveyor means comprising (1) an endless conveyor band projecting front end of the machine frame towards the ballast cleaning machine and extending backwards to the ballast receiving and storage container, the endless conveyor band being displaceable in the operating direction, and further comprising (2) drive means for displacing the endless conveyor band towards the ballast cleaning machine and for retracting it from the ballast cleaning machine.

* * * * *